United States Patent [19]

Schmidt

[11] 4,280,652

[45] Jul. 28, 1981

[54] COVER FOR CONTAINERS

[75] Inventor: Werner Schmidt, Hamburg, Fed. Rep. of Germany

[73] Assignees: Maschinenfabrik Rissen GmbH, Hamburg; 4P Nicolaus Kempten GmbH, Kempten, both of Fed. Rep. of Germany

[21] Appl. No.: 162,038

[22] Filed: Jun. 19, 1980

[30] Foreign Application Priority Data

Jun. 19, 1980 [DE] Fed. Rep. of Germany ..... 2924538

[51] Int. Cl.[3] ..... B65D 5/64; B65D 43/00

[52] U.S. Cl. ..... 229/43; 229/5.6; 220/67

[58] Field of Search ..... 229/43, 5.6, 5.5; 220/352, 67

[56] References Cited

U.S. PATENT DOCUMENTS

| | | | |
|---|---|---|---|
| 2,505,748 | 5/1950 | Barbieri | 229/43 X |
| 3,469,507 | 9/1969 | West | 229/5.6 |
| 3,543,966 | 12/1970 | West | 229/43 |
| 3,956,550 | 5/1976 | Sutch | 229/43 X |

*Primary Examiner*—George T. Hall

*Attorney, Agent, or Firm*—Michael J. Striker

[57] ABSTRACT

A cover for containers made of stiffened deformable material, for example from cardboard, has an annular rim and a plate having a depending flange. The rim has an upper portion, an intermediate portion and a lower portion. The depending flange is positioned adjacent to the intermediate portion. The lower portion is folded around the lower edge of the depending flange and pressed thereto. A three-layer structure of the downwardly extended lower rim insertable into the container provides a highly rigid cover.

9 Claims, 8 Drawing Figures

COVER FOR CONTAINERS

BACKGROUND OF THE INVENTION

The invention relates to covers for containers preferably utilized for paper cups, drawings or the like.

More particularly, the invention relates to covers for containers made from stiffened deformable substantially flat material such as for example, cardboard.

The known covers for containers normally include a cover rim having two telescopically-positioned sleeves of paste board. A cover plate is supported between the front edge of the inner sleeve and the rim of the outer sleeve. The sleeves of such cover are preferably used for drawings and they must be made of a relatively thick material to be able to resist considerably high radial pressures exerted on the walls of the container. In such constructions a reliable connection between the container and the cover is therefore required. The covers produced from the paste board are relatively expensive. The covers made from plastic material are also considerably expensive when utilized in mass-quantity packaging applications.

SUMMARY OF THE INVENTION

It is an object of the invention to provide as an improved article of manufacture a cover for a container, made of relatively thin flat material, such as cardboard.

Another object of the invention is to provide a container cover of relatively high rigidity.

Still another object of the invention is to provide a cover for containers which is easy to hold and easy to insert into the container's opening.

A further object of the invention is to provide a cover with attractive appearance.

These and other objects of the invention are attained by the container cover made of stiffened, deformable, substantially flat material, particularly from cardboard which comprises an annular rim and a plate having a depending flange connected to the plate and having a lower edge. The annular rim includes an upper portion, an intermediate portion and a lowermost portion. The depending flange is adjacent to the intermediate portion, the lowermost portion of the rim is folded around the lower edge of the depending flange to overlap a part thereof and pressed to the flange to form a downwardly extended lower rim of substantially high rigidity insertable into the container. The upper portion of the annular rim is upwardly extended beyond the depending flange.

The downwardly extended lower rim may be terminated with a curved edge.

A radially outwardly extended projection may be formed in the area between the upper portion and the intermediate portion of the annular rim. This projection may be positioned at the transition between the upper portion of the annular rim and the depending flange.

The radially extended projection may be extended over a distance corresponding to the thickness of the container.

The downwardly extended lower rim may be curved toward the central axis of the annular rim.

The downwardly extended lower rim may be inclined toward the central axis of the annular rim.

The outer surface of the cover may be covered by a polymeric material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE INVENTION

Figure 1:
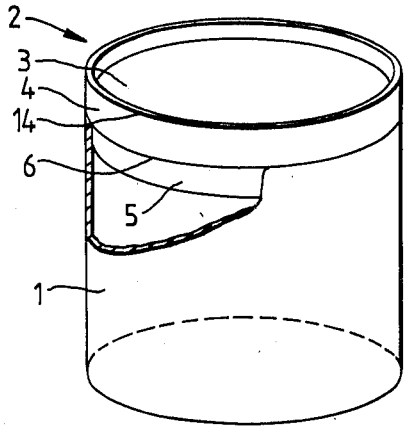
FIG. 1 is a perspective view of a container with a portion removed, and a cover according to the invention.

Referring firstly to FIG. 1, a container designated as 1 is closed by a cover generally denoted as 2. The cover 2 includes a cover plate or disc-shaped member 3 placed over the container's opening and preferably having a substantially flat contour, and a rim portion 4. The rim portion 4 is provided with a lower rim 5 which is inserted into the container. The outer diameter of the lower downwardly extended rim 5 is substantially equal or somewhat greater than the inner diameter of the container 1. The cover rim has a stepwise structure in which the lower rim 5 is separated from the cover rim 4 with a step or projection.

The covers of the foregoing type may be made from a substantially thin cardboard such as is utilized for paper cups. Manufacturing techniques and tools correspond to those used for making paper cups or round boxes of cardboard and need therefore not be discussed in detail.

Figure 2:
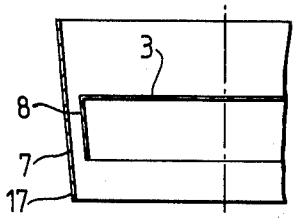
FIGS. 2–6 are fragmentary elevations of the rim of the cover, seen from the interior of the cover and showing the cover in different stages of assembly.

Referring to FIGS. 2–6, the cover 2 of the container is produced from an annularly formed ring 7 which may be slightly tapered. To form the ring 7, a sheet blank is wound about a sleeve and then two overlapped ends of the blank are glued to each other. The cover plate 3 is separately fabricated and provided with the depending flange 8 by deep drawing of a circular cardboard blank and is then placed onto the innerside of the ring 7. The flange 8 of the plate 3 is placed within the inner surface of the ring 7, facing towards the narrower end of the ring 7 but with its free edge spaced from the free edge of the ring 7, as shown in FIG. 2. The plate 3 is placed onto the inner surface of the ring 7 so that the outer surface of the plate is vertically spaced from the upper boundary of the ring 7 which eventually becomes an upper part of the rim portion 4.

Figure 3:
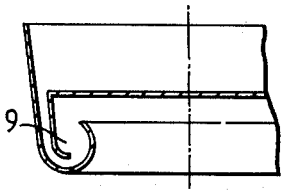
Figure 4:
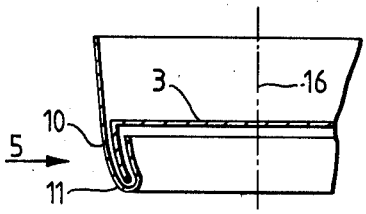

The end portions 17 of the ring 7 are folded around the flange 8 as shown in FIG. 3. The adjacent surfaces obtained as a result of the folding action are connected to each other by means of applying radial pressures to these surfaces to form the lower rim 5 shown in FIG. 4. The flange 8 of the cover plate 3 is inserted and pressed between two folded portions of the ring 7. The pressure may be applied with or without glue or adhesive means, which pressure provides a reliable connection having three-layer uniform structure of essentially great rigidity. The lower rim 5 shown in FIG. 4, has a substantially uniformly curved profile with a curvature directed toward the central axis 16 of the ring 7. In this profile, two segments are separated, namely the plate 3 positioned in the proximity with a part 10 of the ring 7 which will eventually contact the upper end of the container, and a free edge of the lower rim 5 positioned in proximity with a part 11 of the ring 7. The curved profile of the lower rim 5 facilitates insertion of the cover 2 into the container 1. It should be noted that the part 10 located adjacent to the flange 8 of the plate 3 essentially stiffens the whole structure of the cover 2.

Figure 5:
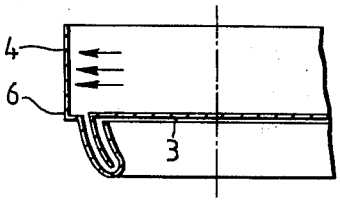
Figure 6:
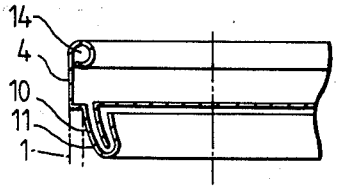

FIG. 5 illustrates a step or projection 6 which is formed on the ring 7 by applying expanding pressures to the surface of the ring 7 in the direction shows by arrows. If desirable, the conicity of the rim portion 4 may be eliminated by deforming the ring 7. In this case the projection 6 is passing through the same plane as the upper surface of the depending flange 3. The upper free edge of the rim portion 4 is folded toward the interior of the ring 7 to form a curved edge 14 to thereby further stiffen the cover 2. As shown in FIG. 6 by dotted lines the length of the projection 6 in the radial direction corresponds to the thickness of container 1.

Figure 7:
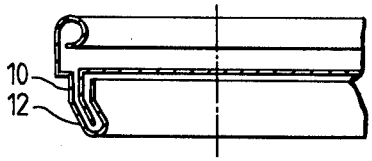
FIG. 7 is a fragmentary elevation showing another embodiment of the rim of the container cover.

FIG. 7 shows another embodiment of the lower rim 5 in which the rim includes a straight part 10 and a sharply inclined part 12.

Figure 8:
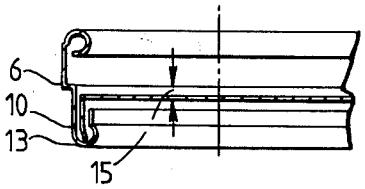
FIG. 8 is a fragmentary elevation showing still another embodiment of the rim of the container cover.

In FIG. 8 the lower rim 5 has a straight downwardly projecting form terminated with a curved edge 13. In this structure only small strip-shaped portions 10 are pressed to each other to clamp the cover plate 3 by applying pressures to their surfaces, the curved edge 13 remains unpressed in this action.

In FIG. 8 the outwardly projecting step 6 is vertically spaced from the outer surface of the plate 3. This clearance indicated by 15 is provided to stiffen the strip-shaped portion 10 of the lower rim 5.

The outer surface of the cover 2 may be covered with a layer of polymeric material.

It will be understood that each of the elements described above, or two or more together, may also find a useful application in other types of cover for containers differing from the types described above.

While the invention has been illustrated and described as embodied in a cover for containers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. As an article of manufacture, a container cover made of stiffened deformable substantially flat material, particularly of cardboard, comprising an annular rim and a plate having a depending flange connected thereto and having a lower edge, said rim including an upper portion, an intermediate portion and a lowermost portion, said depending flange being adjacent to said intermediate portion, said lowermost portion being folded around said lower edge of said depending flange to overlap a part thereof and pressed to said flange to form a downwardly extended lower rim of substantially high rigidity insertable into the container.

2. The article of claim 1, wherein said upper portion of said annular rim is upwardly extended from said depending flange.

3. The article of claim 2, wherein said downwardly extended lower rim is terminated with a curved edge.

4. The article of claim 3, wherein a radially outwardly extended projection is formed in the area between said upper portion and said intermediate portion of said annular rim.

5. The article of claim 4, wherein said projection is positioned at the transition between said upper portion of said annular rim and said depending flange.

6. The article of claim 5, wherein said projection is extended over a distance corresponding to the thickness of the container.

7. The article of claim 6, wherein said downwardly extended lower rim is curved toward the central axis of said annular rim.

8. The article of claim 6, wherein said downwardly extended lower rim is inclined toward the central axis of said annular rim.

9. The article of claim 6, wherein the outer side of the cover is covered with a layer of polymeric material.

* * * * *